United States Patent [19]

Ferrozzi

[11] 3,978,639

[45] Sept. 7, 1976

[54] METHOD AND APPARATUS FOR FORMING PACK WRAPPERS IN CIGARETTE PACKERS

[75] Inventor: Claudio Ferrozzi, Ferrara, Italy

[73] Assignee: AMF Incorporated, White Plains, N.Y.

[22] Filed: Jan. 16, 1975

[21] Appl. No.: 541,473

[30] Foreign Application Priority Data

Jan. 24, 1974 Italy ..... 12443/74

[52] U.S. Cl. ..... 53/32; 53/234; 93/12 C; 93/44.1 R

[51] Int. Cl.[2] ..... B65B 19/24

[58] Field of Search ..... 53/148, 234, 32; 93/12 C, 44, 44.1 R

[56] References Cited

UNITED STATES PATENTS

| | | | |
|---|---|---|---|
| 2,196,666 | 4/1940 | Moore | 53/234 X |
| 2,603,925 | 7/1952 | Moore | 53/234 X |
| 3,553,925 | 1/1971 | Gianese | 53/148 X |
| 3,579,952 | 5/1971 | Davies et al. | 93/12 C X |
| 3,589,097 | 6/1971 | Gianese | 99/12 C X |

*Primary Examiner*—Othell M. Simpson
*Assistant Examiner*—John Sipos
*Attorney, Agent, or Firm*—George W. Price; Charles J. Worth

[57] ABSTRACT

This invention relates to cigarette packaging machines having continuously moving wrapper forming and closing devices. The wrapper forming devices including arbors on which wrappers are formed being rotated 90° on their longitudinal axes during closure of the bottoms of the wrappers and returning to their original position to be filled and transferred to the wrapper closing devices which have holding means for individual packs which are pivoted 90° during closure of the tops or mouths of the packs.

9 Claims, 25 Drawing Figures

1
3
108
13
113
14
15
6
16
19
5
8
17
4
18
9
7

23
22
122
16
4
FS
FC 122
23
22
16
20
18
21
4
FS
FC 16
4
FS
FC

METHOD AND APPARATUS FOR FORMING PACK WRAPPERS IN CIGARETTE PACKERS

This invention relates generally to cigarette packers and more particularly to improved wrapper forming devices therefor.

The cigarette packer concerned is of the type which includes an endless articulated chain, consisting of successive independent wrapper forming devices, each comprising means for forming a wrapper round a tube-shaped box, open at both ends an destined to receive a corresponding orderly cigarette block from a cigarette block forming device. The wrapper so formed, containing a cigarette block, is subsequently transferred by a wrapper forming device of the chain to a corresponding pack end closing device, belonging to an assembly of analogous devices, fitted, articulated and equi-spaced around the periphery of a drum is driven in a preset synchronous motion, together with the chain, and follows side by side a section of the chain path.

With each wrapper forming device as above, a wrapper is formed around the tube-shaped box which is open at both ends. The wrapper is closed at one end and a corresponding orderly block of cigarettes is introduced through the other end which is open into the tube-shaped box. The wrapper formed around the tube-shaped box is a double wrapper composed of a paper sheet and a foil sheet. In the known devices, means associated with each forming device fold the sheets on the tube-shaped box and close the pack bottom prior to the cigarette block introduction.

This invention contemplates an improved wrapper forming device for packers of the above specified type in which each open tube-shaped box is caused to rotate 90° around its own longitudinal axis, in time relationship with the relative forming device operation so that the wrapper bottom is closed by a plurality of fixed folders which cooperate with the wrapper forming devices as a result of the movement of the chain formed by said devices. This improvement similifies the construction of each wrapper forming and packmaking device with obvious advantages both from the economical and operation viewpoint.

The foregoing and other objects and advantages will appear more fully hereinafter from a consideration of the detailed description wherein one embodiment of the invention is illustrated by way of example. It is to be expressly understood, however, that the drawings are for illustration purposes only and are not to be construed as defining the limits of the invention.

Figure 1:
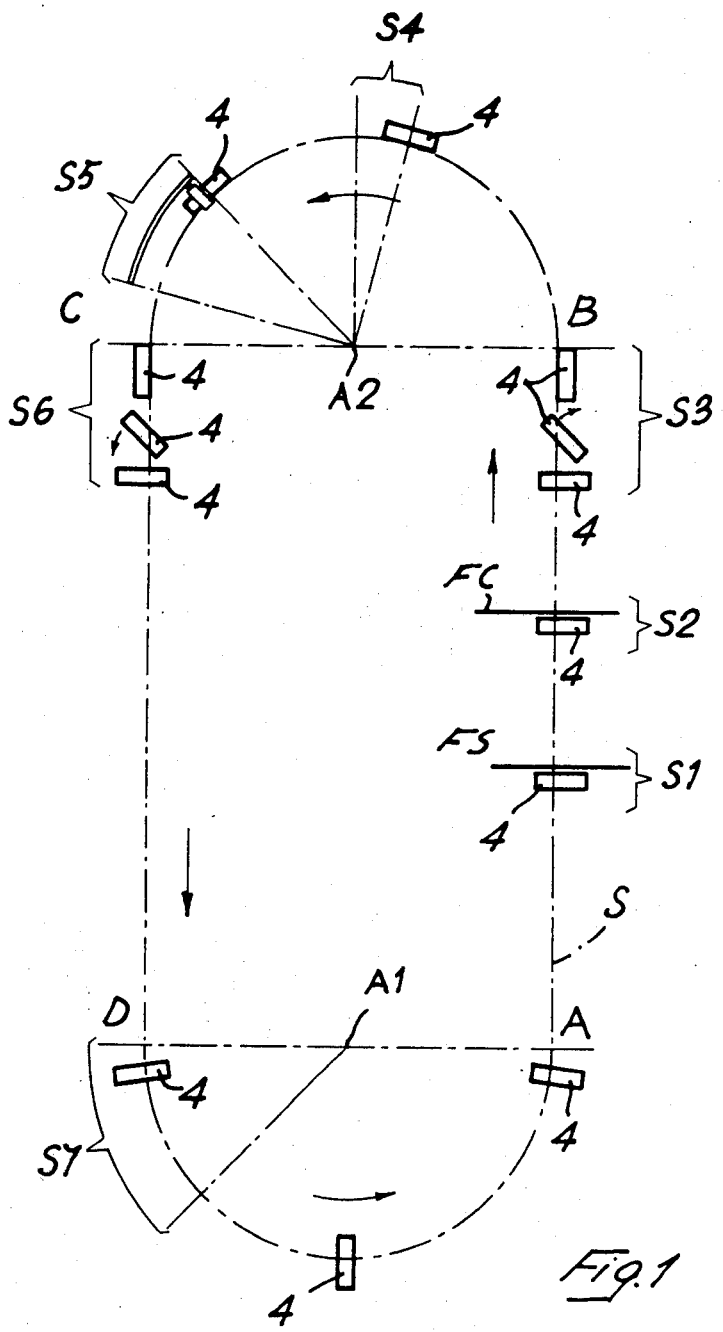
Figure 2:
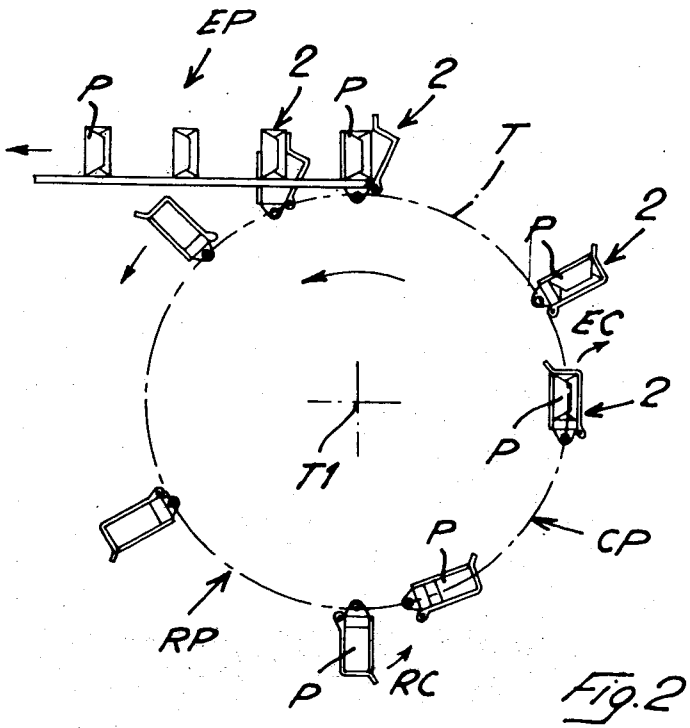
Figures 3, 13, 14, 15:
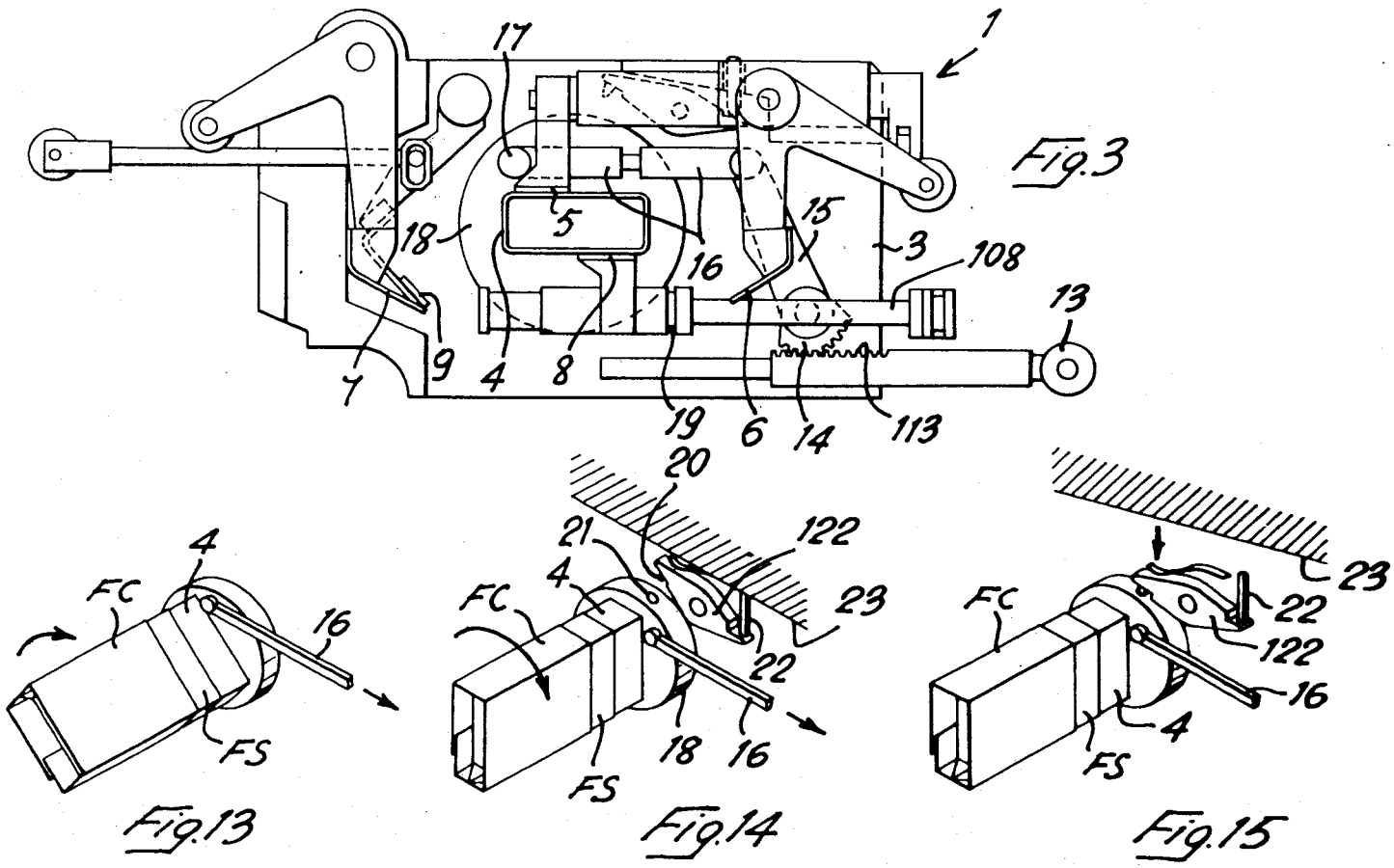
Figure 4:
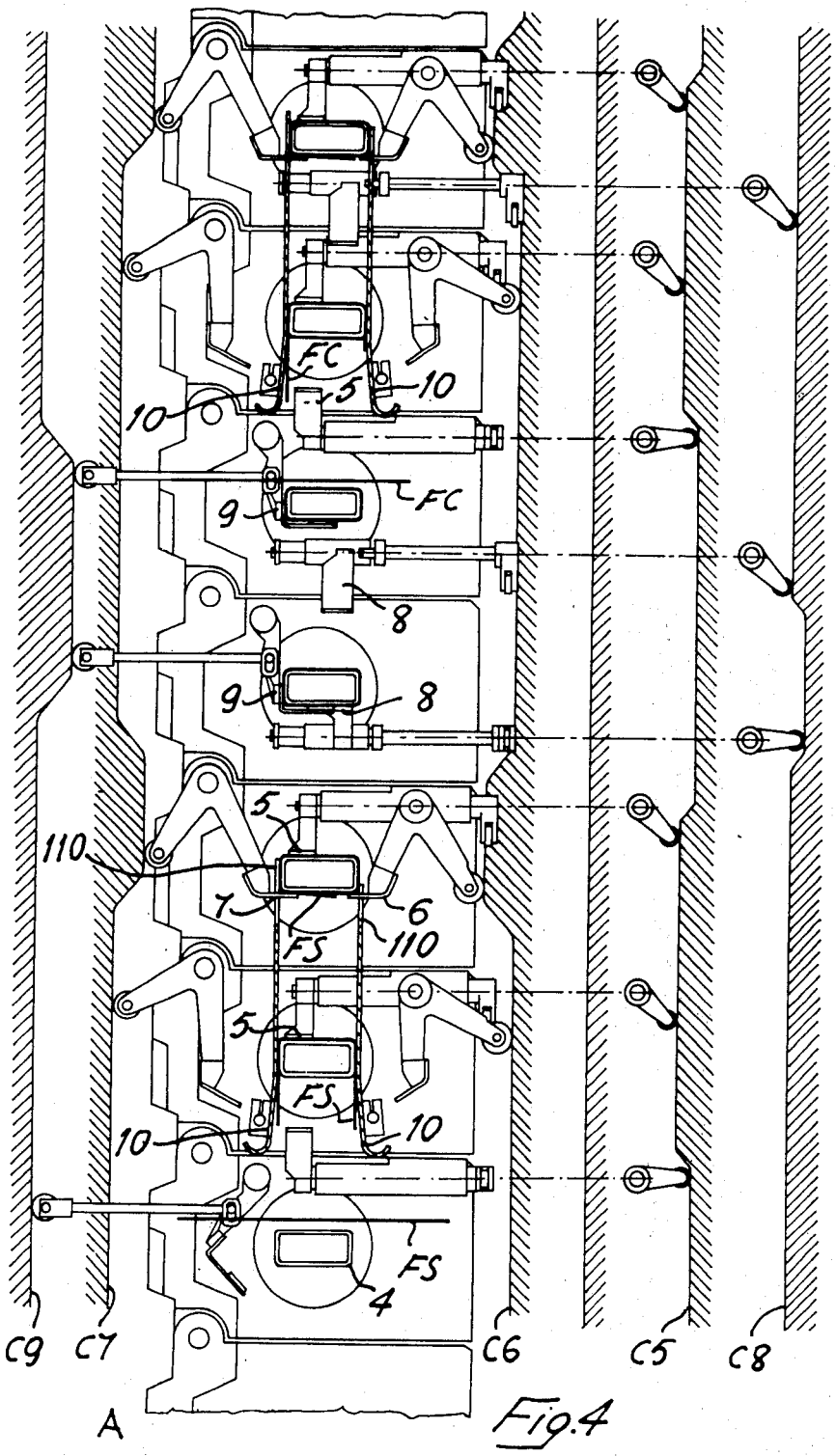
Figure 5:
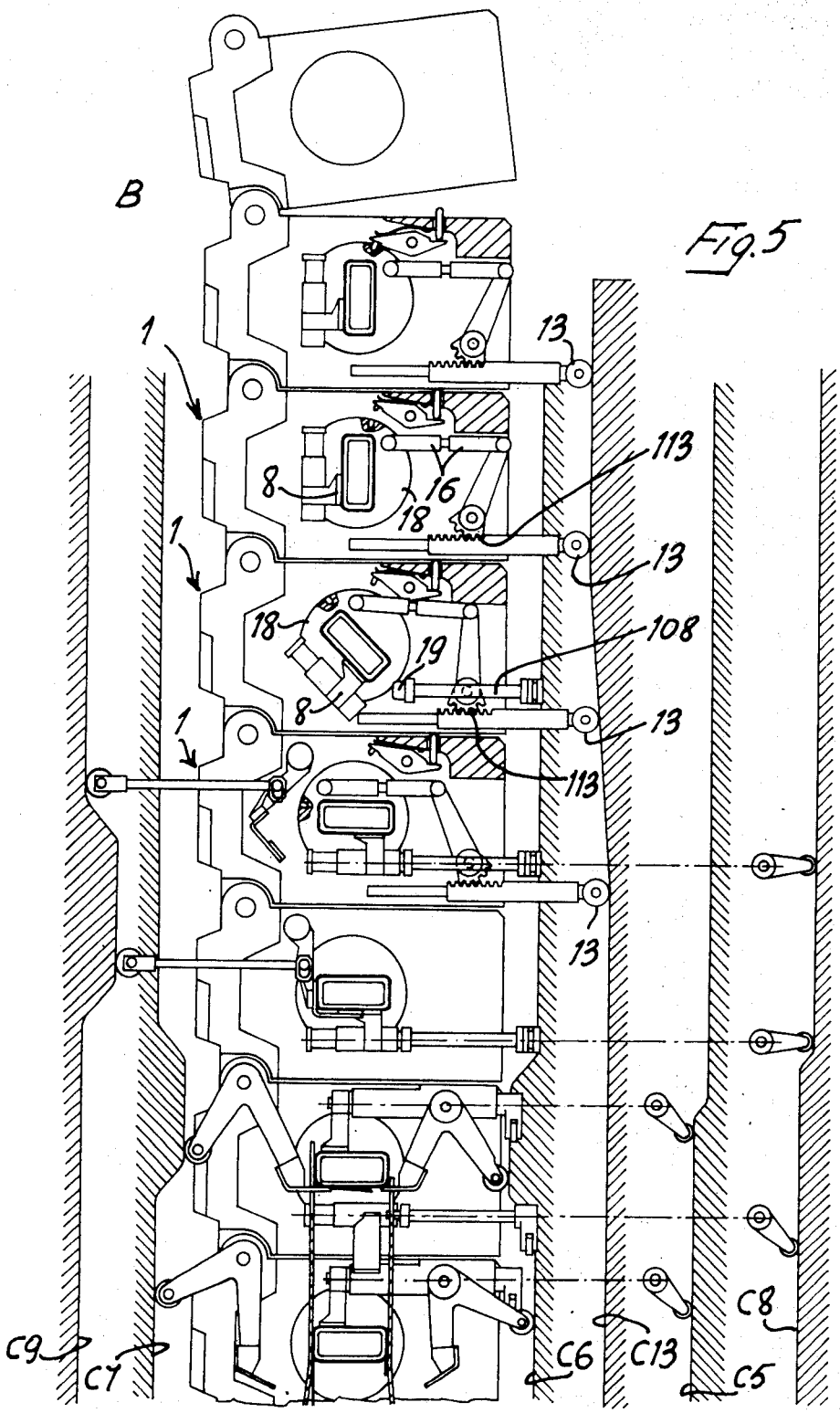
Figure 16:
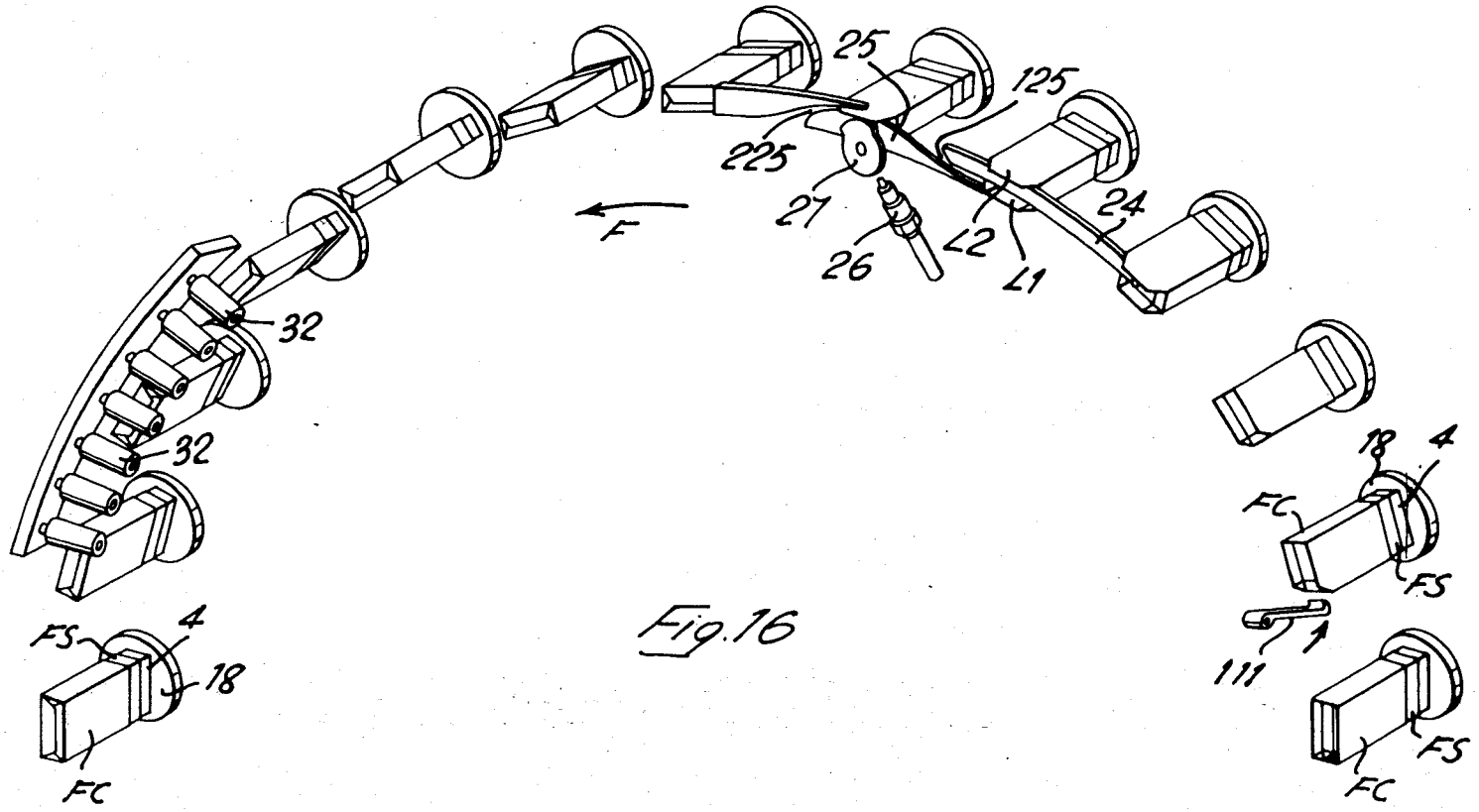
Figure 17:
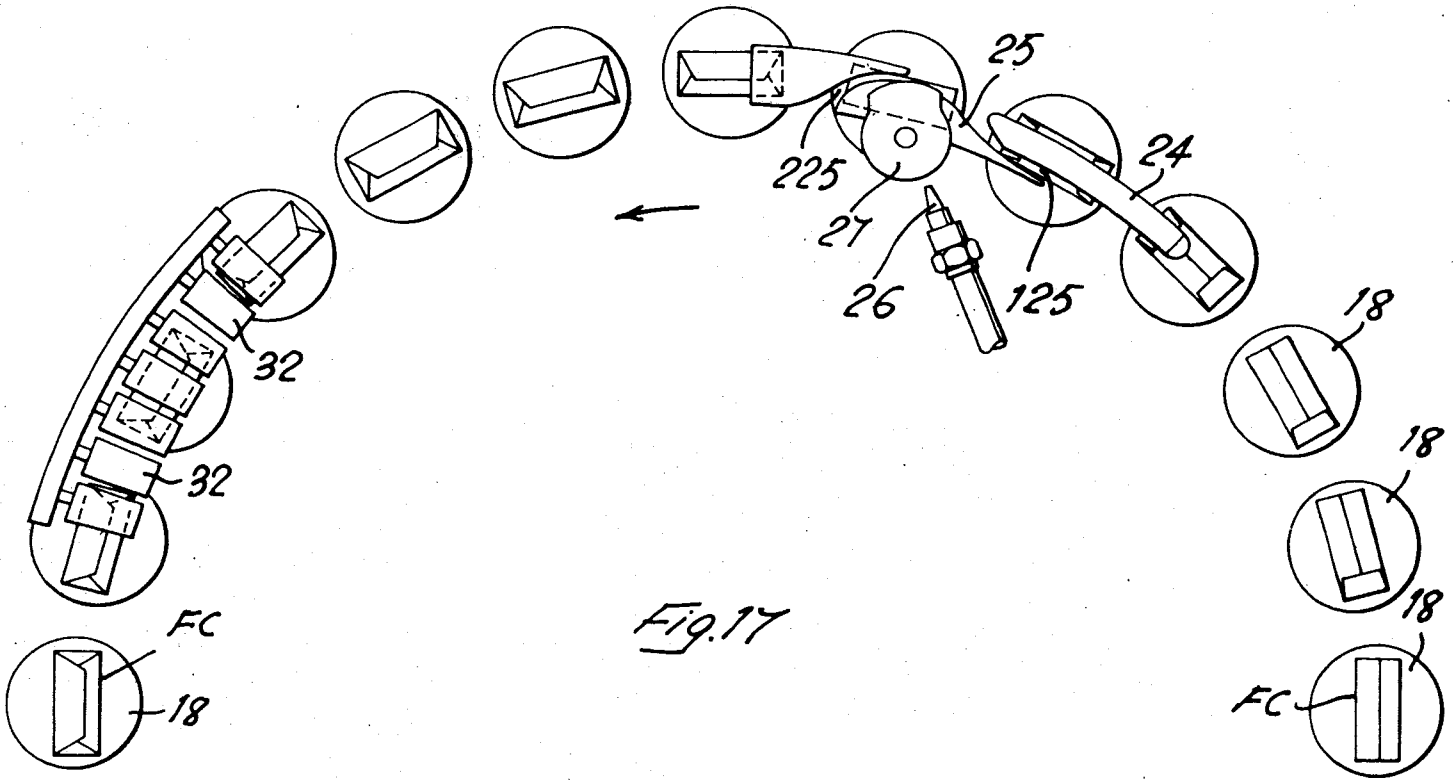
Figure 18:
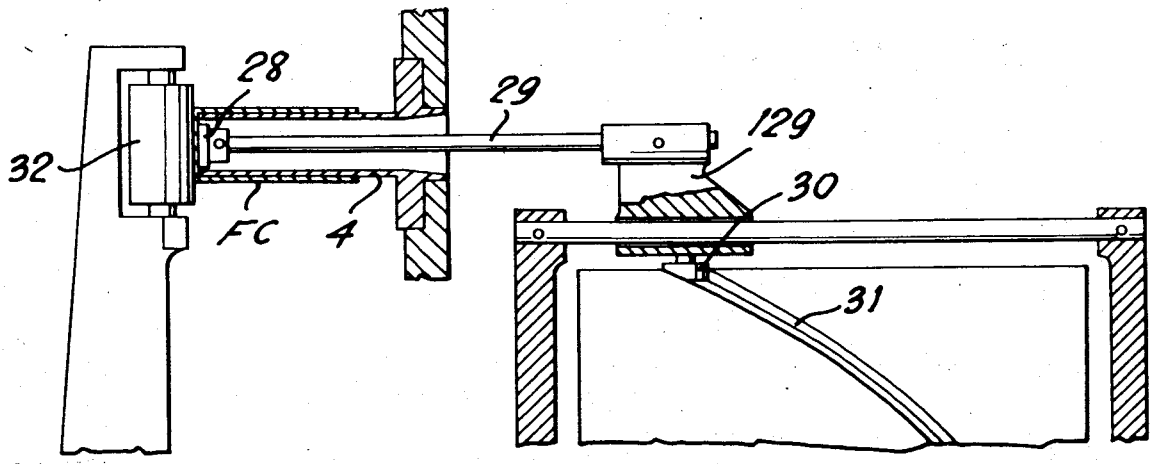
Figure 19:
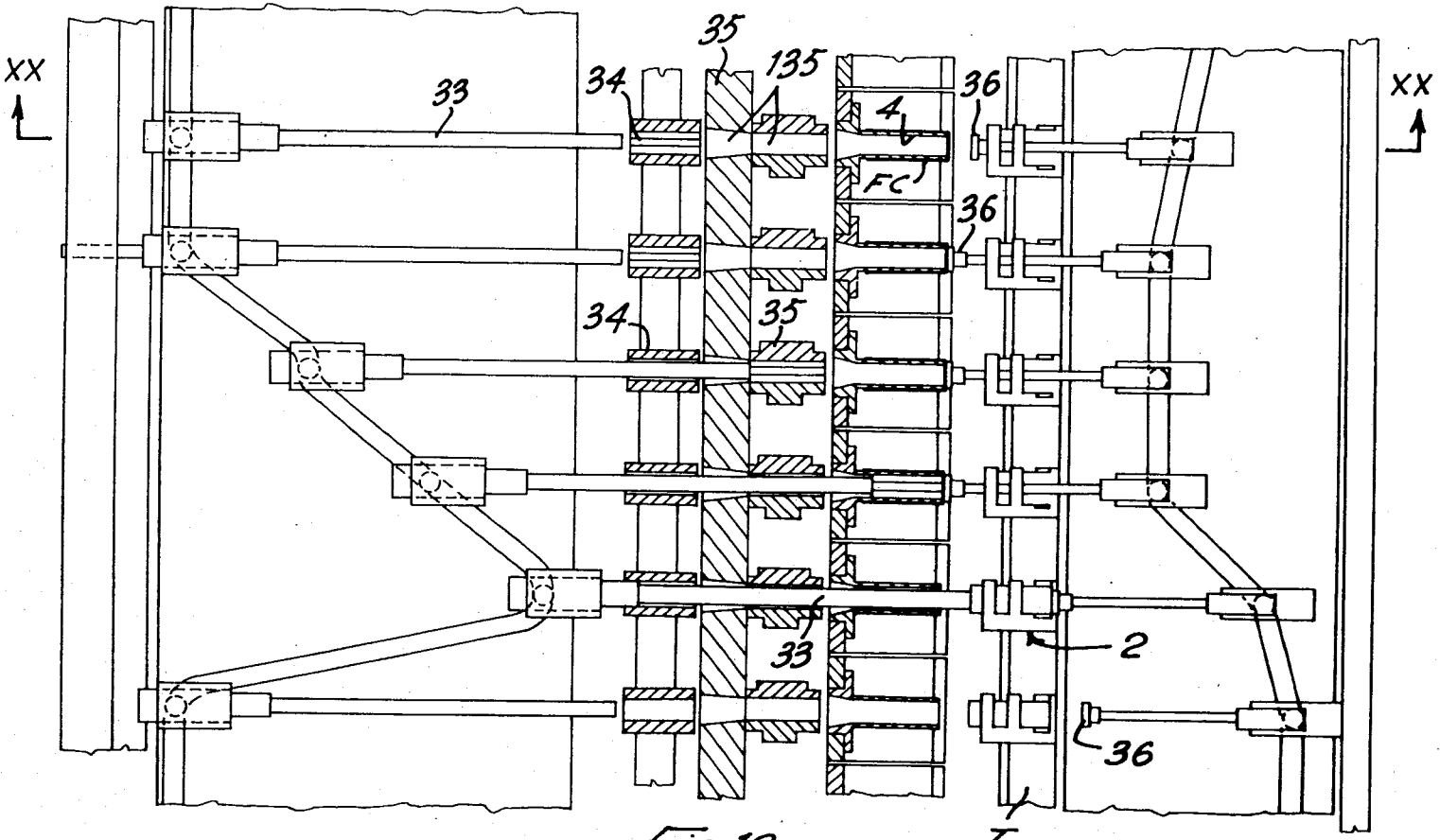
Figure 20:
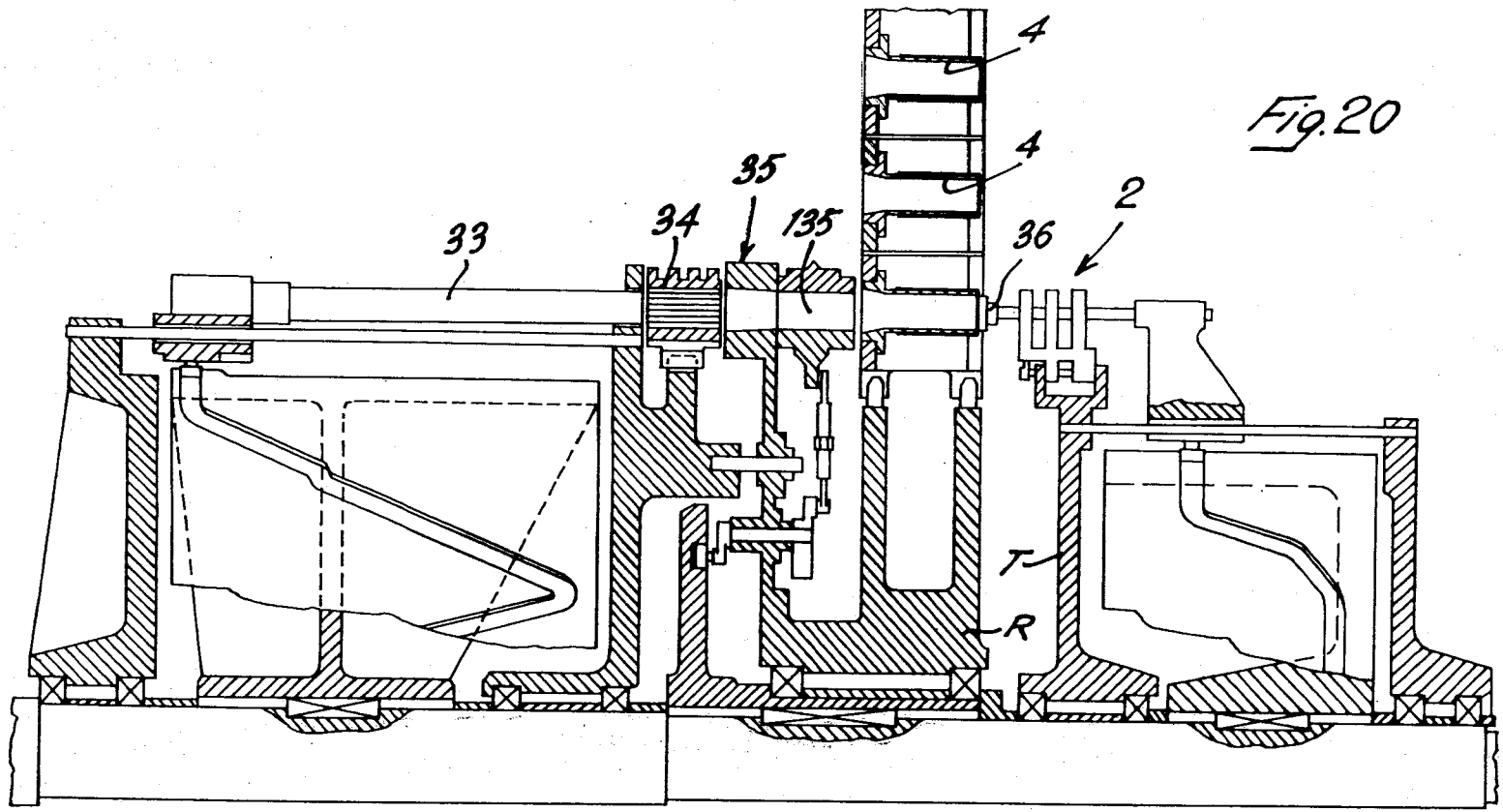
Figure 21:
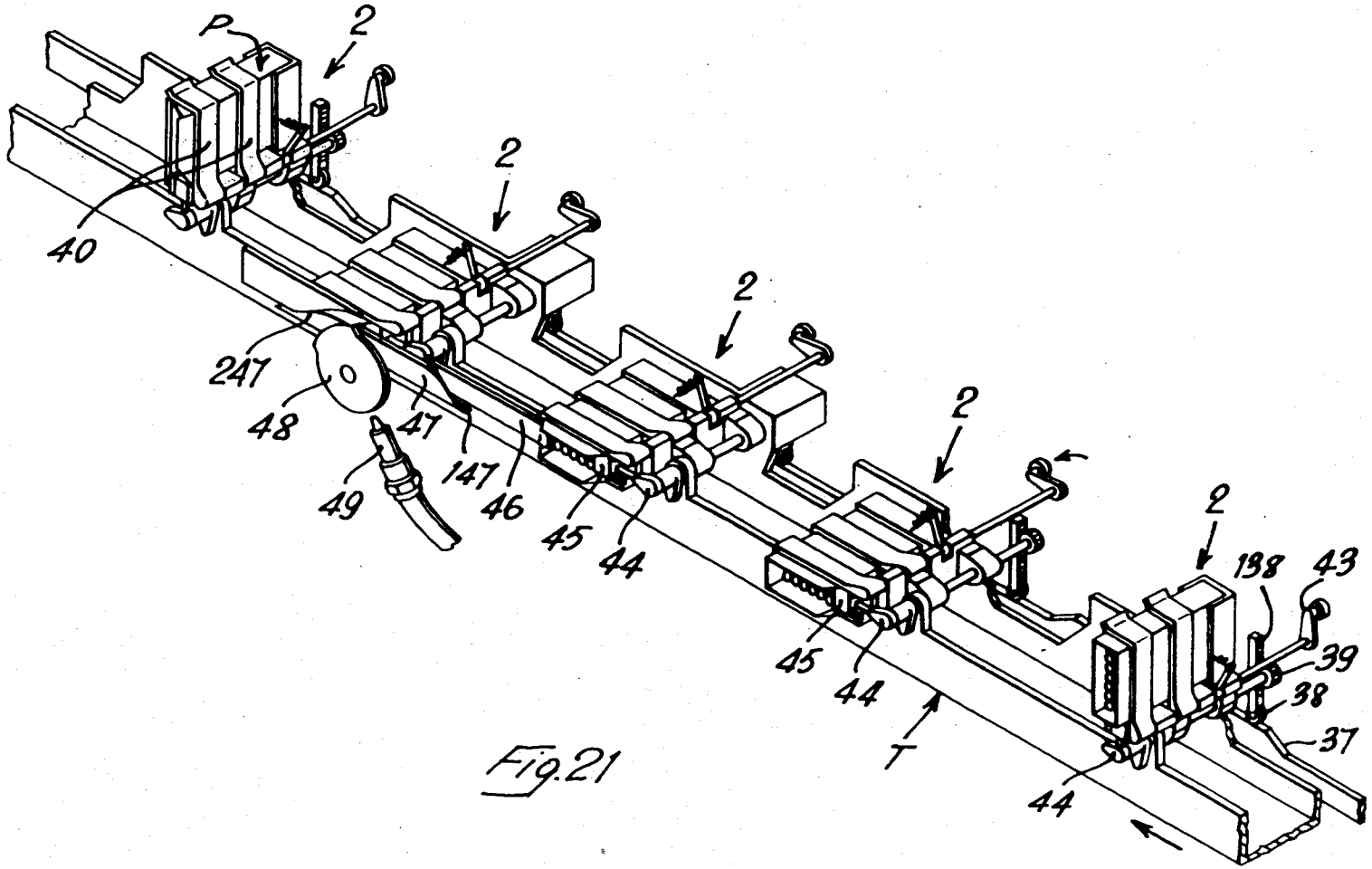
Figure 22:
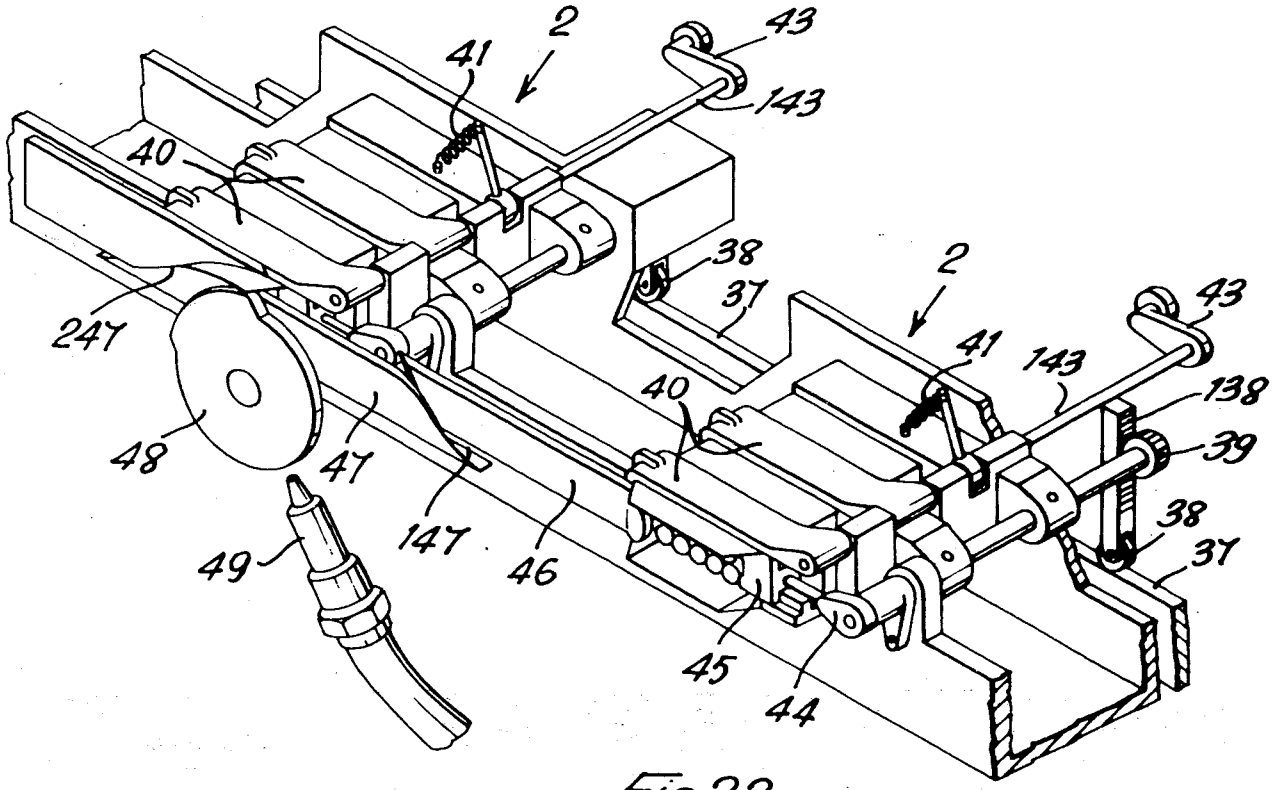
Figure 23:
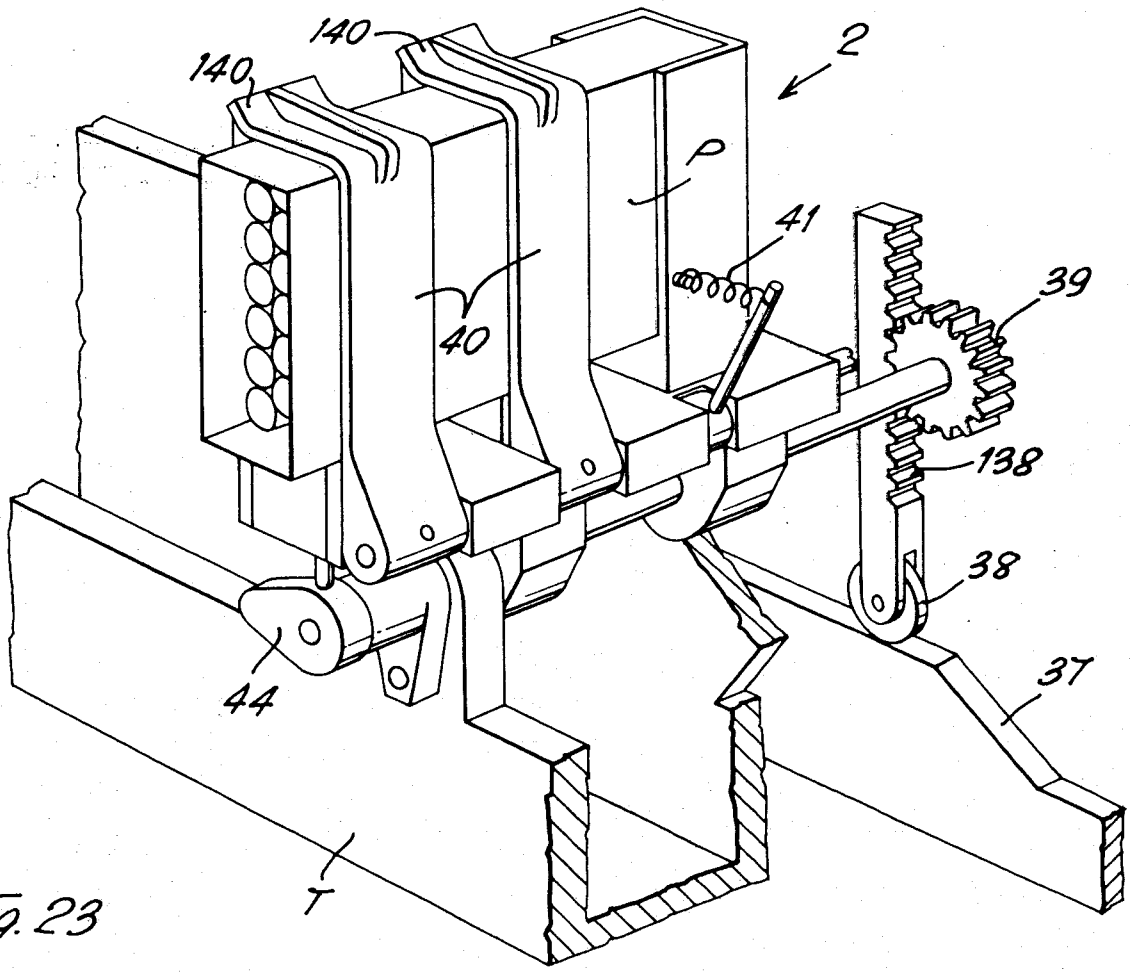
Figure 24:
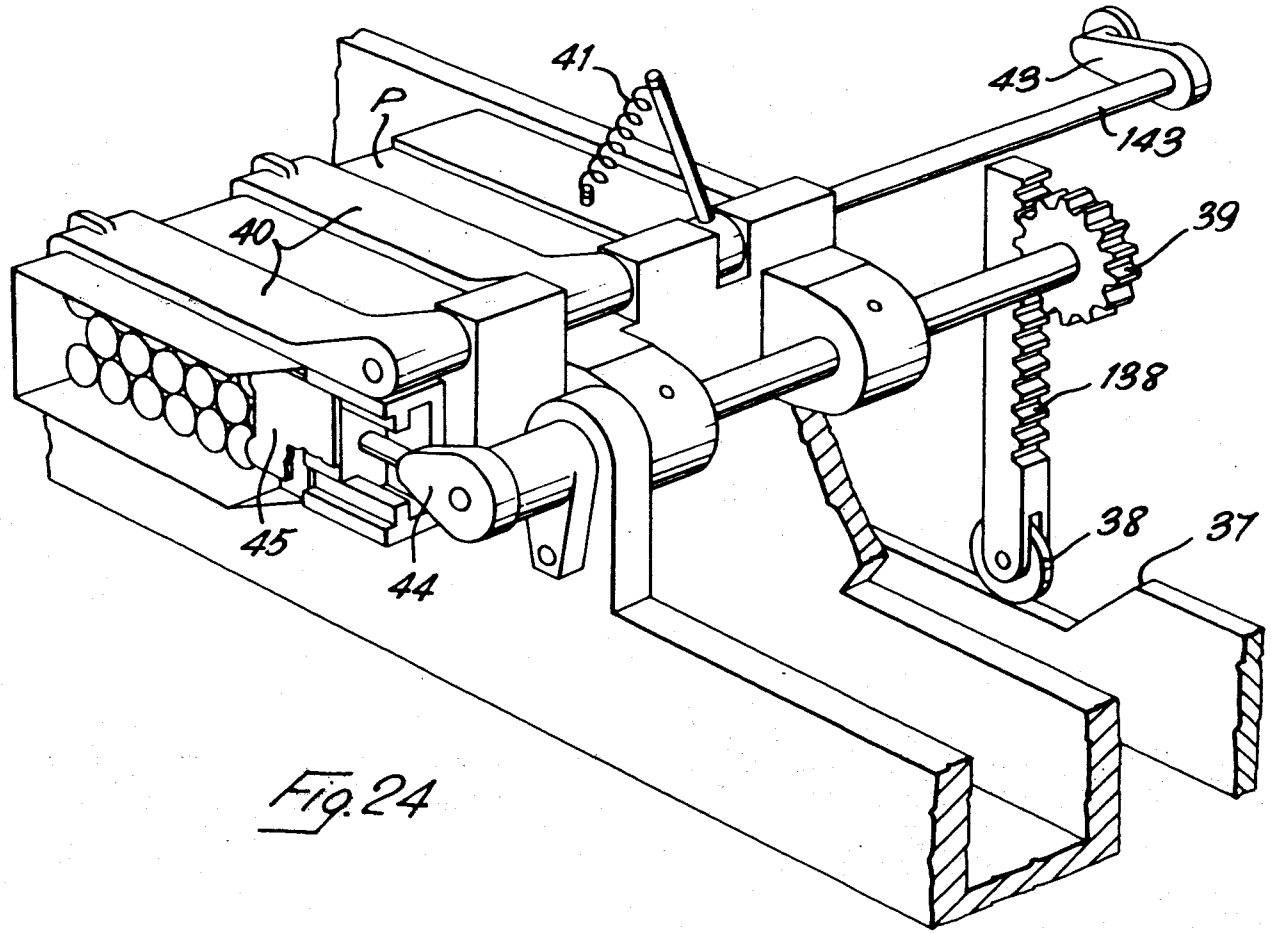
Figure 25:
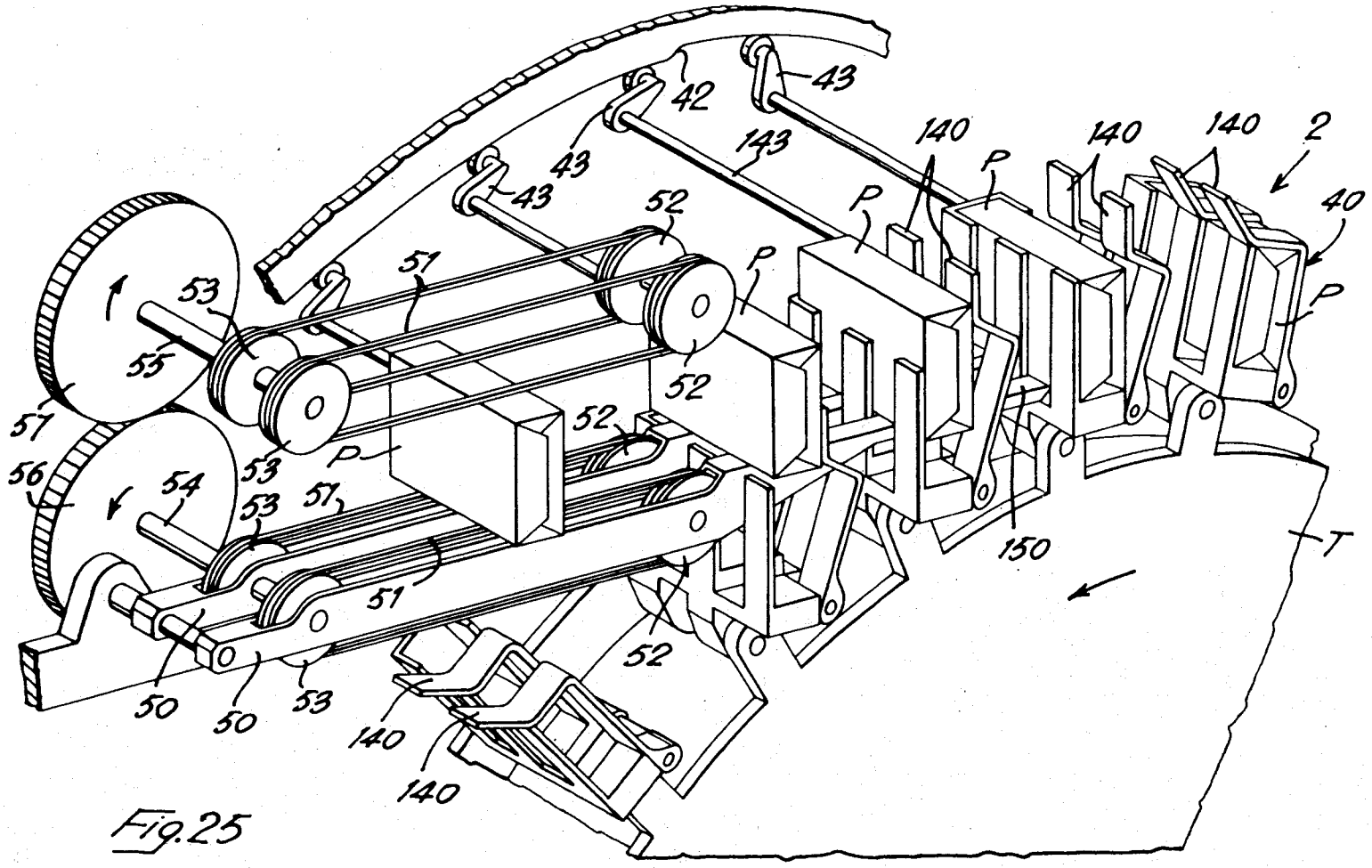

FIG. 1 is a schematic view of an articulated chain of forming and packmaking devices on which wrappers to be filled are formed around hollow boxes in accordance with the present invention, FIG. 2 is a schematic view of a drum associated with the chain of FIG. 1 for closing wrapper mouths after the introduction of the cigarette blocks into the formed packs before transfer to the drum, FIG. 3 is a front elevational view of a forming and packmaking device forming a link of the articulated chain of FIG. 1, FIGS. 4 and 5 are elevational views which when put end to end illustrated the links and associated cams along the ascending rectilinear portion AB of the path of the chain of FIG. 1, FIGS. 6 to 15 are perspective views illustrating the step by step forming of a foil and paper wrapper as the arbor of a link of the chain of FIG. 1 moves along the ascending portion AB of the path of the chain as shown in FIGS. 4 and 5, FIGS. 16 and 17 are perspective an elevational views, respectively, schematically and sequentially showing the wrapper forming operations accomplished by links moving along the arcuate portion BC of the path of the chain of FIG. 1, FIG. 18 is a sectional view of the arbor of one of the chain links and the mechanism operatively associated therewith for sealing the bottom flaps of a wrapper, FIG. 19 is a schematic view partially in section illustrating the feeding of an orderly block of cigarettes into a wrapper on an arbor of a link of the chain of FIG. 1 and the transfer of the filled wrapper to a closing device of the drum of FIG. 2, FIG. 20 is a sectional view taken on line XX — XX of FIG. 19, FIG. 21 is a developed view in perspective of a portion of the periphery of the drum of FIG. 2, FIG. 22 is an enlarged perspective view of a portion of the drum periphery of FIG. 21, FIGS. 23 and 24 are enlarged perspective views illustrating details shown in FIG. 22, and FIG. 25 is a perspective view of a portion of the drum of FIG. 2 and the adjacent finished pack removing means.

With reference to the drawings, a packer embodying the present invention is provided with a plurality of wrapper forming and packmaking devices 1 as is illustrated in FIG. 3 and of a plurality of finishing or closing devices 2, the construction and operation of which are illustrated and described with reference to FIGS. 21 through 25.

The wrapper forming or packmaking devices 1 are successively articulated or pivotally connected to one another to form an articulated endless chain, which is driven along a closed circuit S as shown in FIG. 1 and are guided around suitable pulleys R (see FIG. 20) the geometrical axes of rotation of which are indicated as A1 and A2.

Pack closing devices are articulated and uniformly spaced from each other around the periphery of a drum T (see FIG. 2) the geometrical axis of rotation T1 of which coincides with axis A1, so that drum T rotates side by side with the lower portion of the chain of packmaking devices 1 along the bottom curved section of the chain path S. Drum T is driven on its axis T1, in time relationship with chain S so as to obtain the operative sequence as will be described.

Each packmaking device 1 as shown in FIG. 3 substantially comprises a supporting plate 3, a tube-shaped box or arbor 4 mounted on plate 3 for rotation on an axis coincident with its longitudinal axis, an upper presser 5, two side folders 6 and 7, a lower presser 8 and a side presser 9. Supporting plates 3 of the successive packmaking devices are articulated or pivotally connected to each other in a chain fashion, as illustrated in FIGS. 4 and 5 along the ascending section AB of path S of the chain where wrappers for cigarette packs P are formed on tube-shaped boxes 4 sequentially as illustrated in FIGS. 6 to 15.

As known, the wrapper for a cigarette pack P normally consists of a foil sheet FS and an overwrap paper sheet FC which are fed in an orderly manner to the arbors or tube-shaped boxes 4 moving along path S by means of known feeders located in the areas adjacent path S indicated by S1 and S2 in FIG. 1.

Referring to FIGS. 1, 4 and 5, the foil sheet FS is fed in the direction of the longitudinal axis of an arbor or box 4 (see also FIG. 6) by means well known in the art such as a pair of suction belts (not shown). The foil sheet FS so fed is disposed across the trajectory or path S of tube-shaped box 4 and is lifted thereby and moved between fixed spaced folders 10 causing it to fold on both sides of the box while moving along guides of folders 10 (see FIG. 7). During this movement, the foil sheet FS is held in position on box or arbor 4 by an upper presser 5 which pivots or oscillates downwardly as soon as foil sheet FS has been positioned. This oscillation of presser 5 is operated by a cam C5 (FIG. 4) which as illustrated is developed and rotated 90° to the drawing plane in a manner similar to the other cams shown in FIGS. 4 and 5 to be described.

Figure 8:
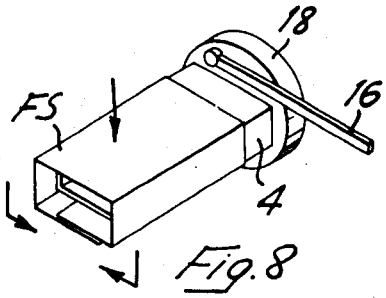

As the arbor or tube 4 with the folded foil sheet FS approach the ends of the fixed folders or guides 10, the side folders 6 and 7 operatively associated with that arbor pivot or oscillate successively toward box 4 further folding the foil sheet FS and superimposing the two resulting flaps of the sheet (see FIG. 8). The folders 6 and 7 extend through the upper ends 110 of guides 10 which are bifurcated or fork-shaped for this purpose. The pivotation or oscillation of folders 6 and 7 is in response to followers moving along respective cams C6 and C7. After the superimposition of the flaps of sheet FS, a lower presser 8 pivots or oscillates upwardly to prevent the flaps from retracting or opening when the two side folders 6 and 7 pivot or oscillate outwardly again thus disengaging sheet FS which has just been folded. The pivotation or oscillation of the lower presser 8 is operated by cam C8 which, in FIGS. 4 and 5, is shown rotated 90° on the drawing from its actual plane. Sheet FS is now as illustrated in FIG. 8.

Figure 9:
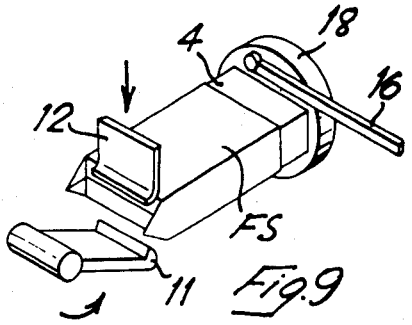

As shown in FIG. 9, a pivotal or rotating folder 11 mounted on fixed structure (not shown) forms the first bottom fold. The peripheral speed of the foot of the folder 11 is higher than the running speed of chain S. A second bottom fold is then formed by a fixed folder 12 as the arbor 4 with the foil sheet FS moves past the folder. At this stage, the foil wrapper FS so formed has, at the bottom short sides, two ears or flaps which will be folded after the paper sheet FC has been overwrapped on the foil sheet and around the hollow tube-shaped box or arbor 4.

Figure 12:
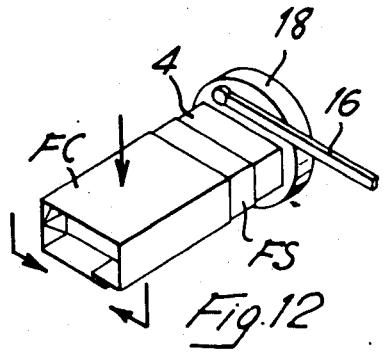
Figure 11:
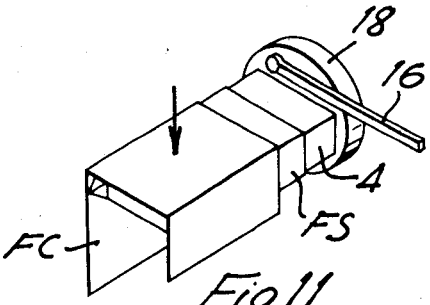
Figure 7:
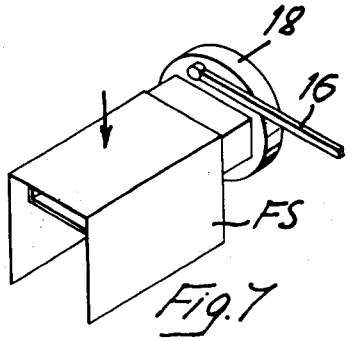
Figure 10:
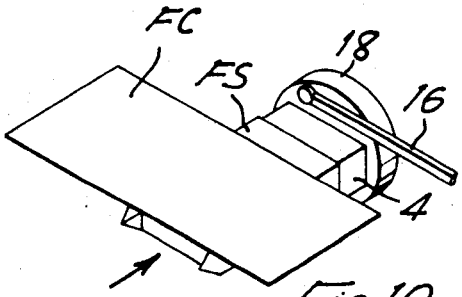
Figure 6:
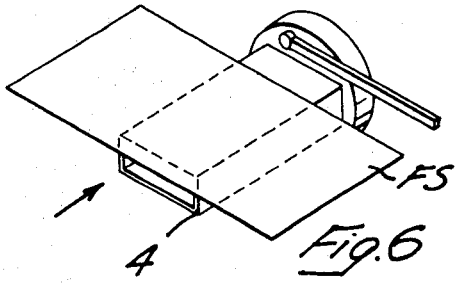

The paper sheet FC (see also FIG. 10) now is to be fed by any suitable means (not shown) well known in the art across the box 4. Just before this feed starts, the foil sheet FS which is wrapped on the box or arbor 4 is still held between the upper presser 5 and the lower presser 8 which must be rotated away from the box 4. However, before the lower presser 6 rotates, a side presser 9 is actuated or moved by a cam C9 into engagement with the bottom of the foil wrap on the box 4 to prevent the superimposed flaps of foil sheet FS from opening. The paper sheet FC is wrapped around the box or arbor 4 in substantially the same manner as the foil sheet FS. The box 4 first passes upwardly between a second pair of fixed folders or guides 10 causing the paper sheet to be folded as shown in FIG. 11. The top or upper presser 5 is moved by cam C5 into contact with the paper sheet FC and as the box or arbor 4 leaves the guides 10, cams C6 and C7 cause the respective folders 6 and 7 to fold the flaps of the paper sheet FC around the box 4 one over the other as shown in FIG. 12.

Sequentially, the upper presser foot moves away from the box 4, the lower presser foot 8 is pivoted by the cam C8 into engagement with the superimposed flaps of the paper sheet FC as the flaps are released by the folders 6 and 7.

The tubular boxes or arbors 4 each have a spaced pair of larger sides and a spaced pair of smaller sides providing a size and shape substantially conforming to a package of cigarettes. Up to this point during the wrapping of a foil sheet FS and the overwrapping of a paper sheet FC, the longer sides of the box 4 being wrapped are disposed transverse to the ascending portion AB of the path S of the chain. The wrapped box 4 has now entered the zone S3 as shown in FIG. 1.

As a link 1 of the chain moves through the area or zone S3, the tubular box or arbor 4 thereof is rotated 90° on its geometrical longitudinal axis in a clockwise direction as viewed in FIGS. 1 and 5 so the longer sides of the arbor are then disposed parallel to the track S. Each link 1 in addition to having a body or plate 3; an arbor 4; pressers 5, 8 and 9; and folders 6 and 7; is provided with arbor rotating means best shown in FIGS. 3 and 5 and arbor holding or locking means best shown in FIGS. 3, 5, 14 and 15.

To rotate the tubular boxes or arbors 4, each is provided with a circular or disc-like base 18 rotatably mounted on the plate or body 3 of a link 1. The base 18 is connected by a link 16 to the free end of a crank arm 15 which is pivotally mounted at its other end to the body 3. The mounted end of the arm 15 is provided with a sector gear 14 in mesh with a rack gear 113 on a tappet 13 which is a follower moving along a cam C13. As shown at the upper portion of FIG. 5, as a tappet 13 moves along the rise of cam C13, it moves axially causing the arm 15 through meshed gears 113 and 14 to pivot and, in turn, through the link 16 causes the box or arbor 4 to rotate.

As shown in FIG. 1, the box or arbor 4 remains in its rotate position as the link 1 moves along the upper arcuate portion BC of the path S. To prevent inadvertent or early return of an arbor 4 to its original position, each link 1 is provided with a spring biased rocker arm 122 having a pin 22 at one end that extends upwardly to normally engage the bottom 23 of the preceding link 1 to hold the arm 122 rotated against the force of the biasing spring. The other end of arm 122 is provided with a lock pin or detent 20 which extends in a direction opposite to that of pin 22 and is normally held spaced from the arbor base 18 which is provided with a peripheral recess or indent 21 aligned with pin or detent 20 when the arbor 4 is rotated as shown in FIG. 14.

As a link 1 moves into the arcuate portion BG of the path S as shown at the top of FIG. 5, it will move on its pivotal connection away from the next succeeding link 1. The pin 22 of the next succeeding link 1 is free to move outwardly and the biasing spring causes the rocker arm 122 to rotate and move the pin or detent 20 into the recess or indent 21 as shown in FIG. 15 thus locking the arbor 4 against rotation.

Since tube-shaped box or arbor 4 is caused to rotate after foil and paper sheets FS and FC have been wraped around it, the lower presser 8 holding the foil and paper sheets in position must follow box 4 in its axial revolving motion to prevent the superimposed flaps of these sheets from opening back. For this purpose, the oscillating presser 8 is mounted on the disk 18 and coupled to a shaft 108 of the relative cam follower by means of a clutch 19 which spontaneously disengages it from shaft 108, when disk 18 rotates towards towards the position illustrated in FIG. 4. This disengagement appears evident in FIG. 5, where the sequence of this rotation can be followed for three consecutive pack-making devices 1 in chain S.

FIGS. 16 and 17 illustrate the operations performeed in the portion or section BC of chain path S. After the tube-shaped box or arbor 4 is locked through the insertion of pin 20 in notch 21, at the beginning of curved section BC, as described above a pivoted folder 111, the peripheral speed of the foot of which is higher than that of the chain and is in agreement with it, makes at the same time, the first bottom fold of the paper wrapper and that of one of the two ears of the foil wrapper at the end of one of the smaller sides of the package being made. A second bottom fold is obtained by fixed folder 24. This occurs in concomitance with the folding of the other foil wrapper ear at the end of the other smaller side.

At his stage (see area or zone S4 of FIG. 1), paper wrapper FC has still two ears or flaps L1 and L2 at the two bottom larger sides of the package being made. The ear or flap L1 is folded on the bottom of the empty wrapper or package being formed on box or arbor 4, while passing through diagonal notch or slot 125 of a fixed folder 25. Then, ear L2, after receiving the glue from the glueing device comprising spray nozzle 26 and buffer wheel 27, is folded and superimposed on ear L1, while passing through the diagonal notch or slot of the fixed folder 25.

After the double wrapper is so completed, in the area or zone S5 of FIG. 1 a presser 28 (see FIG. 18) on the end of a rod 29 which is guided forward and backward into the box or arbor 4 by a slide 129 with a follower 30 riding in a fluted cam 31, presses against rollers 32 the freshly glued bottom of the wrapper which has just been formed against rollers 32 to ensure perfect sealing. Links 1 with wrappers sealed at their bottoms now leave the area or zone S5 where rollers 32 are provided and start their descent along the vertical portion or section CD of the path S of FIG. 1.

Links 1 which pivotally separated in the area or zone S3 which permitted the locking means to engage the rotated arbors 4, now pivotally move together as they enter the area or zone S6 of the path S of FIG. 1. It should be readily understood that the bottom or trailing surface 23 of each link 1 now depresses the pin 22 extending from the next successive link causing the rocker arm 122 to rotate against its spring bias thus moving the pin or detent 20 out of the recess or indent 21 thus freeing the arbor 4 to be rotated counterclockwise, as viewed in FIG. 1, by its cam means to its original position with the larger sides of the tube-shaped box or arbor 4 disposed transverse to the path S.

The double wrapper or package so formed must now be filled with a cigarette block, that is, with an orderly group of cigarettes, and its mouth or top of the package must subsequently be closed. The method and means for transferring the cigarette block into the double wrapper are known and can be, for instance, of the type described in U.S. application No. 515,783 filed Oct. 17, 1974 and assigned to the same assignee as the present application or any other suitable means well known in the art. Briefly, this means as shown in FIGS. 19 and 20 is accomplished in the area or zone S7 of the path S of FIG. 1. As shown, bars or pushers 33 are cammed axially to transfer orderly groups of cigarettes, first from containers 34 in which they are formed, into pockets 135 of a compressor drum 35 and, then, from these pockets 135 into the wrappers formed on the tube-shaped boxes or arbors 4.

As previously noted, the drum T carrying pack end closing devices 2 rotates on an axis T1 (FIG. 2) which is coaxial with the axis A1 (FIG. 1) of the lower pulley R for the chain of links 1. The arbors 4 moving along the lower arcuate portion or section DA of the path S around axis A1 are aligned with and move at the same speed as the pack end closing devices 2.

A feature of the improvement or object of this invention lies, however, in a particular arrangment which has been devised with the purpose of preventing the bottom of the package paper wrapping containing the group of cigarettes from being damaged during the transfer from an arbor or tube-shaped box 4 to a corresponding device 2 of drum T. This arrangement is also used to allow the transfer of packs with Improperly formed or glueless bottoms. Before cigarettes touch the freshly glued wrapper bottom, a plunger 36 crosses or extends through a closing device 2 until it contacts the bottom of an aligned wrapper still on an arbor tube-shaped box 4. This enables the glued or sealed bottom to withstand the cigarette thrust on the wrapper during the pack transfer into closing device 2 by a pusher 33. Pack end closing devices 2 are hinged to a drum T, a sector of which is developed for simplicity's sake, and viewed in perspective in FIG. 21. Referring generally to FIGS. 21 to 25, each device 2 is pivotally mounted on the drum T by a shaft with a gear 39 fixed to the end of such shaft and in mesh with a rack gear 138 of a tappet 38 forming a follower for a fixed cam 37. This mechanism will cause a device 2 to rotate and assume, depending upon the location of the tappet 38 on the cam 37, on of three positions, namely radial relative to drum T as shown in FIG. 23 to receive a pack P filled with cigarettes from an arbor 4, tangential as shown in FIGS. 22 and 24 when the open top of a pack P is to be closed and vertical as shown in FIG. 25 when a finished pack P is to be transferred away from the drum T.

Part of the rear wall of the pocket of each device 2 (rear in relation to the direction of rotation of the drum T) consists of a concave 40 formed by a pair of L-shaped elements, hinged to the pocket bottom. This concave is kept closed by spring 41 thus retaining the pack P in the pocket of device 2. A cam 42 (FIG. 25), by means of a cam follower or roller lever 43, mounted on the end of a shaft 143 can open said concave 40 for pack ejection according to the sequence described hereinafter. After receiving a pack P in the area RP of FIG. 2 a pocket of a device 2 rotates or oscillates forwardly in the area RC of FIG. 2 with relation to the direction of rotation of drum T, as a result of the movement of follower 38 on cam 37, and assumes a tangential position relative to the drum T. During this rotation or oscillation, cam 44 (FIGS. 23 and 24) actuates a folder plate 45 (FIG. 22) which makes the first pack top fold.

As the drum T continues to rotate a fixed tongue or folder 46 (see FIGS. 21 and 22) makes the second top fold; a diagonal notch 147 of the fixed folder 47 engages folds upwardly; the pack mouth long lower flap or ear; and a diagonal notch 247 of the fixed folder 47 engages folds downwardly the pack mouth long upper flap or ear superimposing it on the already folded flap (eventually, but not necessarily, wetting it with glue, for instance, by means of a disk 48 and a nozzle 49 associated with it). This completes pack closing and in the area EC of FIG. 2 the pocket of device 2 is moved back into radial position.

FIG. 25 illustrates the detail of the finished pack ejector associated with the devices 2 of the drum T. This ejector comprises substantially a pair of fixed horizontal guides 50 having appropriately shaped ends which extend into pockets of successive devices 2 and under a pack P approximately in the highest peripheral point of drum T. However, before said guides 50 interfere with the circular path of a pack P carried around drum T, cam 42 and follower 43 opens retaining concave 40. Then, as soon as a pack P is so released it is contacted by guides 50 and the cam 37 causes the pocket to remain vertical in the area EP of FIG. 2 during the pack ejection time. While moving on guides 50 the pack is kept upright by the paddle-shaped terminal parts 140 of concave 40.

When completely out of the pocket of a device 2, a pack P is moved along the guides 50 by pairs of belts 51 which transfer it, for instance, to a defective pack ejector or to a stamper (not shown). The belts 51 of each pair are tensioned between respective pairs of terminal pulleys 52 and 53, the corresponding pulleys of each pair being rotatably mounted on the same geometrical axis. For example, the two pulleys 52 of the lower pair of belts 51 supporting the pack P being discharged are mounted on pins while the pulleys 53 for the same pair of belts are keyed to a common shaft 54. Also the two pulleys 53 of the upper pair of belts 51 are keyed to a common shaft 55 which is parallel to shaft 54. The two shafts 54 and 55 are coupled to each other by means of a pair of meshed gears 56 and 57 to provide a unitary drive ratio and thus assure a simultaneous and concordant operation of the upper and lower pairs of belts 51. Suitable drive means (not shown) may be coupled to one of the gears 56 and 57.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

I claim:

1. A method for forming and closing pack wrappers in cigarette packers comprising the steps of:

providing a set of packmaking devices each with a tube-shaped box and a set of pack closing devices, the devices of each set being connected to one another and continuously driven along a closed path at least in part adjacent the path of the other set of devices.

forming a foil sheet around each tube shaped box and folding a pair of opposed flaps at one end of said sheet at the bottom of the pack wrapper being formed, forming a wrapper sheet around each foil sheet which together provide a pack wrapper, rotating each tube shaped box and pack wrapper thereon to change its orientation relative to the path of said packmaking devices and folding the bottom flaps of the pack wrapper thereby closing one end thereof, returning each tube shaped box and pack wrapper thereon to its original orientation relative to the path of said packmaking devices and filling each pack wrapper, transferring each filled pack wrapper from a packmaking device to an adjacent pack closing device and pivoting each filled pack wrapper to change its orientation to the path of said packmaking devices while folding the flaps at the mouth end thereof, and thereafter returning each pack wrapper to its original orientation.

2. A method according to claim 1 in which the orientation of the empty pack wrappers while folding the pack wrapper bottom flaps with fixed folders is changed by each packmaking device by rotating the respective tube-shaped box around its longitudinal axis substantially 90°.

3. A method according to claim 2, and changing the orientation of each filled pack wrapper relative to the path of said pack closing devices to fold the filled pack wrapper mouth flaps with fixed folders by rotating each filled pack wrapper substantially 90° around an axis parallel to the longitudinal axis of the pack wrapper.

4. Apparatus for forming, filling and closing pack wrappers in cigarette packers, comprising a plurality of packmaking devices pivotally connected one to another forming an endless chain continuously driven along closed path, each of said devices being provided with a base plate and a tube-shaped box mounted at one end to said base plate for rotation on its longitudinal axis disposed transverse to closed path;

means or sequentially forming foil sheets around said boxes, folding pairs of opposed flaps from said foil sheets across the ends of said boxes opposite from said mounted ends thereof and forming wrapper sheets over the foil sheets thereby forming pack wrappers as said devices more progressively along their closed path;

means disposed in a fixed position adjacent a portion of the closed path for folding and gluing flaps provided by the sheets extending past the ends of said boxes opposite from their mounted ends as said devices move past said means thereby closing the bottoms of the pack wrappers being formed;

cammed means for rotating said boxes before and after passing said means disposed in a fixed position adjacent the closed path thereby changing the orientation of the pack wrappers relative to the closed path before their bottoms are closed and returning the pack wrappers to their original orientation after their bottoms are closed;

means for inserting orderly blocks of cigarettes into tube-shaped boxes having pack wrappers with closed bottoms thereby filling said pack wrappers;

a plurality of pack closing devices connected together in an endless series continuously driven along a generally circular path adjacent in part to the closed path of said packmaking devices, each of said pack closing devices having a pivotal pocket for receiving filled pack wrappers from said packmaking devices;

means for transferring filled pack wrappers from said tube-shaped boxes to aligned pockets;

fixed means disposed adjacent the circular path for folding flaps and closing the mouth ends of filled pack wrappers; and means for causing said pockets to pivot on axes parallel to their longitudinal axes to change the orientation of the filled pack wrappers relative to the circular path only when their mouth ends are being closed.

5. Apparatus according to claim 4 in which said means disposed in a fixed position adjacent a portion of the closed path includes fixed folders comprising a pivotal tucker for making a first fold on one of the wrapper bottom short sides, a bar for the second fold on the other of the wrapper bottom short sides, and successively after said bar a pair of shaped plates which in cooperation with each other form a pair of diagonal facing notches which engage one after the other the paper wrapper flaps corresponding to the pack bottom long sides and fold them one over the other thus completing the pack wrapper bottom.

6. Apparatus according to claim 5 in which said means disposed in a fixed position adjacent a portion of the closed path further includes a gluer is operatively associated to said diagonal notches to apply the glue to the last folded flap, in order to stick to each other the wrapper bottom folded long flaps.

7. Apparatus according to claim 6 and a roller surface, and a buffer movable into the tube-shaped boxes carrying pack wrappers and pressing the bottom flaps thereof against said roller surface to ensure an efficient adhesion of the just formed wrapper bottom flaps.

8. Apparatus according to claim 7 and a slidable plunger provided to externally engage the bottoms of filled pack wrappers while such wrappers are transferred to said pack closing devices thereby preventing the wrapper bottoms from damage and allowing the transfer of filled pack wrappers with ill-formed or glueless bottoms.

9. Apparatus according to claim 8 further comprising a rotating drum, said pack closing devices being pivotally mounted in an orderly manner free to oscillate on the periphery of said rotating drum, the axis of rotation of each pack closing device being parallel to the axis of rotation of said drum.

* * * * *

UNITED STATES PATENT OFFICE

CERTIFICATE OF CORRECTION

PATENT NO. : 3,978,639

DATED : September 7, 1976

INVENTOR(S) : Claudio Ferrozzi

It is certified that error appears in the above-identified patent and that said Letters Patent are hereby corrected as shown below:

Claim 4, line 15, make "more" read

--move--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*